US009865959B2

(12) United States Patent
Bertsch

(10) Patent No.: US 9,865,959 B2
(45) Date of Patent: Jan. 9, 2018

(54) MODULAR PLUG-IN CONNECTOR

(71) Applicant: Amphenol Tuchel Electronics GmbH, Heilbronn (DE)

(72) Inventor: Michael Bertsch, Heilbronn (DE)

(73) Assignee: Amphenol Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 14/437,635

(22) PCT Filed: Sep. 14, 2013

(86) PCT No.: PCT/EP2013/002774

§ 371 (c)(1),
(2) Date: Apr. 22, 2015

(87) PCT Pub. No.: WO2014/072005

PCT Pub. Date: May 15, 2014

(65) Prior Publication Data

US 2015/0280351 A1 Oct. 1, 2015

(30) Foreign Application Priority Data

Nov. 12, 2012 (DE) ..... 20 2012 010 735 U

(51) Int. Cl.
*H01R 13/518* (2006.01)
*H01R 13/514* (2006.01)
(Continued)

(52) U.S. Cl.
CPC ..... *H01R 13/514* (2013.01); *H01R 9/2608* (2013.01); *H01R 12/7005* (2013.01);
(Continued)

(58) Field of Classification Search
CPC ..... H01R 13/514; H01R 13/518; H01R 13/6456; H01R 9/2608; H01R 12/7005
(Continued)

(56) References Cited

U.S. PATENT DOCUMENTS

| | | | |
|---|---|---|---|
| RE29,780 E | 9/1978 | Rutkowski | |
| 6,503,108 B1 | 1/2003 | Kikuchi et al. | |
| 7,762,857 B2 * | 7/2010 | Ngo et al. | 439/747 |

FOREIGN PATENT DOCUMENTS

| | | |
|---|---|---|
| CN | 102394431 A | 3/2012 |
| DE | 1590072 A1 | 4/1970 |

(Continued)

OTHER PUBLICATIONS

International Search Report issued in PCT/EP2013/002774, dated Dec. 9, 2013.

*Primary Examiner* — Felix O Figueroa

(74) *Attorney, Agent, or Firm* — Blank Rome LLP; Charles R. Wolfe, Jr.; Tara L. Marcus

(57) ABSTRACT

The invention relates to a plug-in connector comprising a frame (10) for detachably latching a plurality of contact support modules (20, 21) of the width 0.5×B, 1×B, 1.5×B or 2×B, the frame being formed by two mutually opposed longitudinal lateral walls (11) and by two mutually opposed transversal lateral walls (12), wherein at least two contact support modules (20, 21) of different width can be received in and latched to the frame, the contact support modules having at least one latching element (23) that interacts with a corresponding counter-latching element (13) arranged on the frame in order to detachably secure the contact support modules in the frame, a rigid grid of latching elements being arranged externally on the longitudinal lateral walls (11) of the frame (10) at a uniform grid spacing of the counter-latching elements (13) of 0.5×B.

14 Claims, 5 Drawing Sheets

(51) Int. Cl.
*H01R 13/645* (2006.01)
*H01R 12/70* (2011.01)
*H01R 9/26* (2006.01)
*H01R 13/64* (2006.01)

(52) U.S. Cl.
CPC ..... *H01R 13/518* (2013.01); *H01R 13/6456* (2013.01); *H01R 13/64* (2013.01)

(58) Field of Classification Search
USPC ..... 439/701, 712, 715, 724
See application file for complete search history.

(56) References Cited

FOREIGN PATENT DOCUMENTS

| | | | |
|---|---|---|---|
| DE | 8111418 | U1 | 11/1981 |
| DE | 3142182 | A1 | 4/1983 |
| DE | 3834651 | A1 | 4/1990 |
| DE | 9301220 | U1 | 3/1993 |
| DE | 9201367 | U1 | 6/1993 |
| DE | 19533295 | C1 | 4/1997 |
| DE | 19724375 | A1 | 10/1998 |
| DE | 102006004238 | A1 | 8/2006 |
| EP | 0097255 | A1 | 1/1984 |
| EP | 0202916 | A2 | 11/1986 |
| EP | 1063731 | A2 | 12/2000 |
| EP | 2581991 | A2 | 4/2013 |
| FR | 2514956 | A1 | 4/1983 |
| FR | 2605464 | A1 | 4/1988 |
| JP | S-55033586 | A | 3/1980 |
| JP | H0574514 | | 3/1993 |
| JP | 2001015223 | A | 1/2001 |
| JP | 2003534640 | A | 11/2003 |
| JP | 2009087953 | A | 4/2009 |
| WO | WO-9403941 | A1 | 2/1994 |

* cited by examiner

T
20
23
24
H
SECTION A-A 10
11
12
12
02
Amphenol
heavy|mate®
modular
GD-ZN
B
B/2
B/2
A
A
10
24
26
30
25
B
1,5 x B
B/2

MODULAR PLUG-IN CONNECTOR

This application is the national phase of International Patent Application No. PCT/EP2013/002774, filed Sep. 14, 2013, which claims the benefit of German Patent Application No. 202012010735.6, filed Nov. 12, 2012, which is hereby incorporated by reference.

The invention relates to a modular plug-in connector in accordance with claim 1.

Plug-in connectors of this type are disclosed by way of example in DE 81 11 418 U1 and EP 0 097 255 B1.

The plug-in connector in accordance with EP 0 097 255 B1 is plugged onto a carrier body on which in turn is fastened a conductor connection block that is embodied from disc-shaped insulating segments that are arranged in a row one adjacent to the other. The insulating segments comprise recesses and the associated contact elements are inserted into said recesses.

In order to render it possible to access the contact elements even in the plugged-in state, it is further provided that chamber-shaped apertures are provided in the insulating body and a pin-shaped extension of the end regions of the contact elements protrudes into said apertures. The insulating bodies comprise in each case a depression on their upper surface and a spacing bolt that is screwed to the outer face of a frame part is inserted—transverse with respect to the insulating segments—into said depression. Said spacing bolt and frame part are positioned against one another as a result of the fact that the segments are screwed on.

In the case of the known embodiment, the number, position and allocation of the individual insulating bodies are fixed in advance. It is necessary to detach the spacing bolt, remove the frame and free the contact body from the carrier body in order to exchange the insulating bodies before a new configuration can be provided.

DE 38 34 651 A1 discloses socket contacts that are retained in a modular manner. The support bodies on the frame longitudinal parts are embodied as beveled strips which results in a weakening of the frame. Plug-in connectors are known in many different embodiments. Since the housings and the frames of plug-in connectors of this type are standardized in many cases (for example in the standard DIN 43 652), but on the other hand there is a great demand for customer specific or application-orientated contact configurations, it is desirable to provide plug-in connectors that can be equipped with contact arrangements that can be freely configured.

DE 87 17 110.441 discloses a plug connection in which a frame comprising two parts is provided and contact modules of various embodiments can be inserted into said frame. The frame is embodied from two separated frame parts and one of said frame parts comprises on each longitudinal side a guiding rail having a reference edge. The contact modules have in each case laterally corresponding connecting pieces so that they cannot fall through the frame part in their installed state. The second frame part is mounted on the first frame part and the contact modules are located in said first frame part and the second frame part is screwed to the first frame part. The second frame part also has lateral connecting pieces that engage in corresponding recesses on the upper face of the contact carrier so that the lateral connecting pieces are held in a captive manner in the screwed-on frame. This solution is problematic insofar as it is relatively complex to assemble and it is subsequently difficult to carry out any necessary maintenance work. Furthermore, the two-part frame is relatively complex to produce and therefore expensive.

E 31 42 182 C2 discloses a plug connection that has exchangeable plug inserts for various plug elements for receiving circuit boards having standardized blade connectors, in this case a female multipoint connector is formed from a single-part frame and segments of various forms, wherein the inner longitudinal sides of the frame are embodied on one side as a rectangular groove and on the opposite-lying side as a prismatic connecting piece, wherein the longitudinal sides of the frame are provided with various apertures for the positive-locking interlocking arrangement of the segments by means of latching lugs.

It is further known from the publication EP 0 202 916 A2 to embody the latching plate with an operating handle that protrudes over the end face of the contact carrier.

The publication DE 93 01 220 U1 discloses a multipole plug connector that comprises a synthetic material base body having contact resilient elements that are provided with contact blades that are allocated to said contact resilient elements for contact purposes. The contact blades are arranged in multiple open chambers of a plug connecting part and the contact resilient elements that are arranged in the synthetic material base body are connected to connecting elements by way of a flexible cable having connecting contacts.

The contact resilient elements that are allocated to the contact blades of the chambers are arranged in multiple synthetic material bodies that are embodied as block-shaped and can be connected to one another and the synthetic material base body comprises cut-outs that are provided with latching means and the synthetic material bodies that are allocated to the chamber can latch in said cut-outs in a detachable manner. The cut-out in the synthetic material base body that is allocated to the chamber can be individually equipped with synthetic material bodies whose contact resilient elements are connected to connecting elements by way of flexible cables.

DE 15 90 072 A1 discloses an electrical connector housing assembly having an insulating plate, wherein electrical connectors are fastened to the plate. The plate comprises a rectangular aperture and multiple rectangular connector housings can be introduced into said aperture. Laterally protruding connecting pieces are provided for this purpose on both sides of a first pair of sides that are arranged opposite one another and said connecting pieces can be detachably connected to the plate.

All the abovementioned systems have the disadvantage that the diversity of variants is limited.

The object of the invention is to provide an improved plug-in connector that can be used in a variety of applications and has detachable contact carrier modules. The single contact carrier or multiple contact carriers should be easy to insert and remove in order to be able to perform testing and maintenance work on the plug-in connector in a rapid manner and without great expense and to render possible a number of different mountable configurations of contact carrier modules.

This object is achieved by means of the features of claim 1. Further embodiments of the invention are defined in the dependent claims.

The invention is based on the consideration that the contact carrier modules on the one hand are embodied in various module widths and on the other hand modules are also provided that comprise widths that are a half-integral multiple (0.5, 1.5, 2.5 etc.) of the width of the basic module having a width D and said contact carrier modules can be detachably fastened to a fixed frame part in a defined modular grid.

In other words, a frame is provided that has a fixed, uniform grid of connecting pieces and connecting piece spacings and both the basic modules as well as the modules having 0.5 multiple, 1.5 multiple, 2 multiple, 2.5 multiple etc. module widths can be detachably latched in said frame.

In accordance with the invention, therefore, a plug-in connector having a frame for detachably latching preferably multiple contact carrier modules having the widths 0.5×B, 1×B, 1.5×B or 2×B is provided, wherein the frame is formed from two opposite-lying longitudinal side walls and two opposite-lying transverse side walls and wherein at least two, preferably more contact carrier modules of various widths can be received in the frame and can latch with the frame.

Furthermore, the contact carrier modules comprise at least one latching element that cooperates with a corresponding mating latching element that is arranged on the frame in order to fasten the contact carrier modules in the frame in a detachable manner and wherein a fixed grid of these latching elements is arranged on the exterior of the longitudinal side walls of the frame and indeed in a uniform modular grid dimension of the mating latching elements of 0.5×B (half width of a basic contact carrier module).

In this manner, it is possible to provide a plug-in connector into which it is possible to latch the standard contact carrier modules of the width B and also contact carrier modules of the width 0.5×B and also in the width 1.5×B that corresponds to three times the width of the half contact carrier module of the width 0.5×B.

Consequently, it is possible to insert integral multiples of the width B/2 of a standard or rather basic contact carrier module, thus contact carrier modules of the width B or 2×B or provided that the frame is embodied as sufficiently large also multiples of the width n×B/2.

Therefore, a grid of latching ribs that corresponds to the half width of a standard module of the width B is provided in accordance with the invention in the frame, preferably on the outer face of the longitudinal side walls of the frame.

As a result of arranging a grid in the width B/2 it is thus possible to arrange odd integral multiples such as the 0.5 multiple and 1.5 multiple of the standard or basic contact carrier module of the width B and as a consequence increase the number of various possible applications.

In a particularly advantageous embodiment, the contact carrier modules comprise latching elements on which are likewise arranged latching arms in a spacing of 0.5×B. Thus, for example, a module that comprises the 1.5 multiple width of the basic contact carrier module of the width B (in other words the width 1.5×B) is provided with three latching arms, while the basic contact carrier module is provided with two latching arms and the half contact carrier module is provided with one latching arm for each side. Altogether one can say therefore that a module that comprises n times the width B consequently provides 2 n resilient element arms on each side.

In a simplified embodiment of the present invention, a plug-in connector is provided in which the frame can receive at least one basic contact carrier module of the width B and at least one contact carrier module of the width 0.5×B or rather in which a contact carrier module of this type is received.

In an advantageous manner, the plug-in connector is characterized in that each contact carrier module comprises in each case a latching element on two sides that lie opposite one another.

It is particularly advantageous if one or multiple latching arms are directly arranged on the latching element.

In a particularly preferred embodiment, the multiple in each case adjacent latching arms of a contact carrier module are embodied with a spacing of 0.5×B on the contact carrier module or directly on the latching element.

It is furthermore advantageous if the respective adjacent latching arms of directly adjacent contact carrier modules that latch in the frame directly adjacent to one another are embodied on the contact carrier module with a spacing of 0.5×B.

In other words, this means that, when inserting and latching contact carrier modules of various widths, on the one hand adjacent resilient element arms of a contact carrier module are spaced at a grid spacing of 0.5×B while also latching arms of various but directly adjacent contact carrier modules are likewise spaced at a spacing of 0.5×B with respect to one another.

It is further advantageous if the contact carrier modules are provided with a locating groove in each case on a side that faces the longitudinal side edge of the frame.

Alternatively, the contact carrier modules can also be provided with multiple locating grooves on a side of this type.

It is particularly advantageous if the contact carrier modules are provided with one or multiple further locating grooves in each case on the second side that is also lying opposite thereto and is aligned with the opposite-lying lateral edge of the frame and indeed in such a manner that said locating grooves are arranged diametrically, laterally offset with respect to one another so that the contact carrier module can only be plugged in and latched in a single alignment in the frame.

It is particularly advantageous if therefore the frame comprises corresponding locating ribs on the inner face of each of its longitudinal side walls in a grid with the grid dimensions of 0.5×B and wherein in each case opposite-lying locating ribs are likewise arranged diametrically offset from one another.

In other words, this means that a grid of locating ribs is arranged on each inner face of the longitudinal side walls of the frame in a grid dimension of 0.5×B, wherein the opposite-lying rows of locating ribs are arranged diametrically offset with respect to one another on the in each case opposite-lying inner face of the longitudinal side walls.

In a particularly advantageous embodiment, the plug-in connector in accordance with the invention is further provided with a basic contact carrier module of the width B and/or with a contact carrier module of the width 0.5×B and/or with a contact carrier module of the width 1.5×B and/or with a contact carrier module of the width 2×B.

In a further advantageous embodiment, multiple latching arms of a contact carrier module are connected to one another by way of a transverse connecting piece and consequently in each case a latching window recess is embodied between two adjacent latching arms and the transverse connecting piece and a latching rib or rather in general a latching element of the frame can latch into said latching window recess. As a consequence, a particularly reliable and secure latching arrangement is achieved between the contact carrier modules and the frame.

Further embodiments of the invention are evident in the dependent claims. The invention is further explained hereinunder with reference to an exemplary embodiment and the figures below. In the figures:

FIG. 1 illustrates multiple embodiments of contact carrier modules;

FIG. 2*a* illustrates a view inclined from above of a frame in accordance with the invention;

FIG. 2*b* illustrates a view in accordance with FIG. 2*a* inclined from below;

Figure 1:
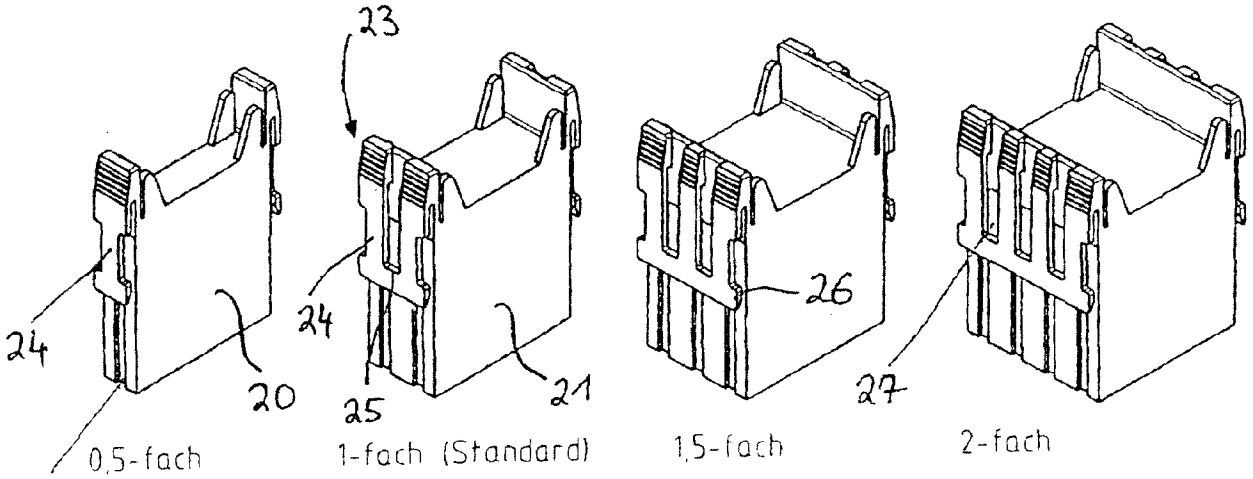
Figure 2B:
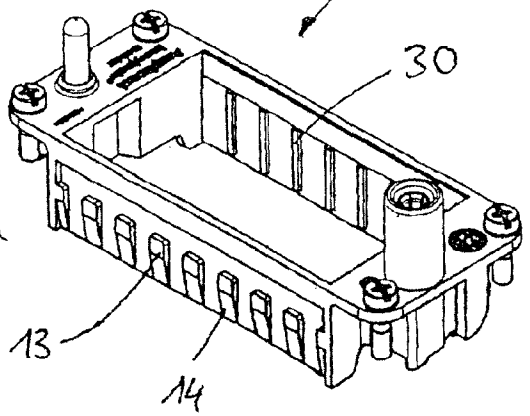
Figure 2A:
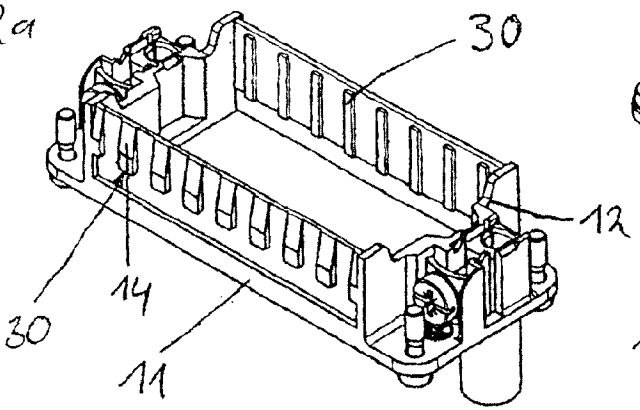
Figure 10:
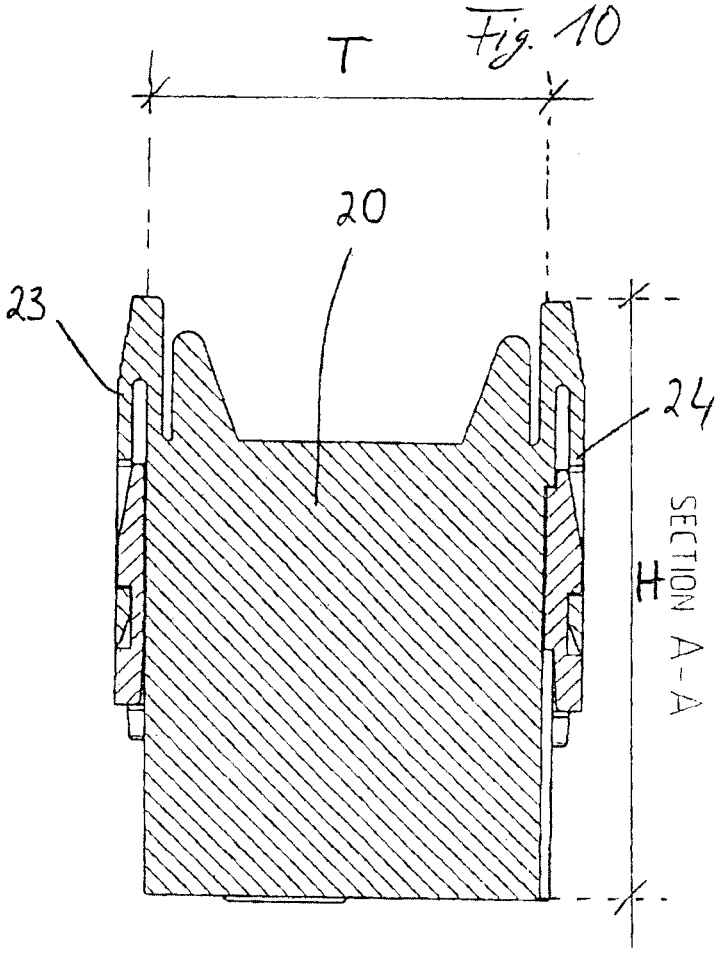
FIG. 10 illustrates a sectional view through a contact carrier module.

FIG. 1 illustrates contact carrier modules 20, 21. The contact carrier modules 20, 21 are embodied in various widths. In the second view from the left-hand side, the standard width B is illustrated. This contact carrier module further comprises a depth T and a height H as is illustrated in FIG. 10.

The contact carrier module 20 having the standard width B is described hereinunder as the basic contact carrier module. A contact carrier module 20 having the width B 0.5×B is located to the left-hand side of said basic contact carrier module. A contact carrier module 20 of the width 1.5×B is located to the right-hand side of the basic contact carrier module and a contact carrier module 20 of the width 2×B is located further to the right-hand side.

Figure 4:
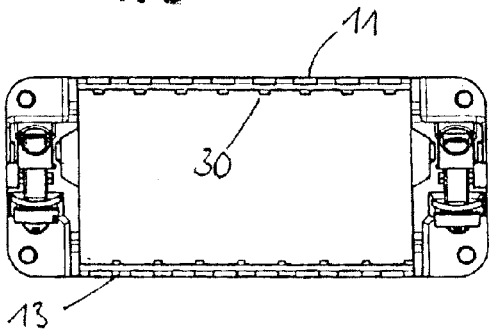
FIG. 4 illustrates a top view of the view in accordance with FIG. 2*a;*
Figure 5:
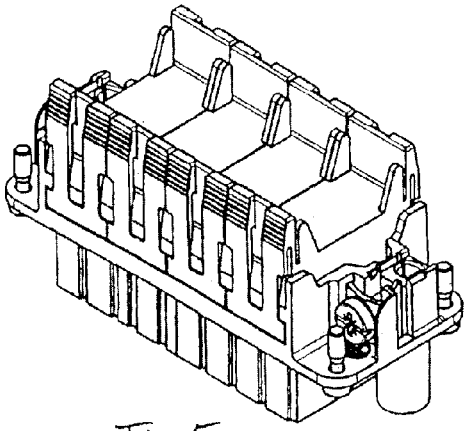
FIG. 5 illustrates a first exemplary embodiment of the invention that is equipped with contact carrier modules.
Figures 11, 12:
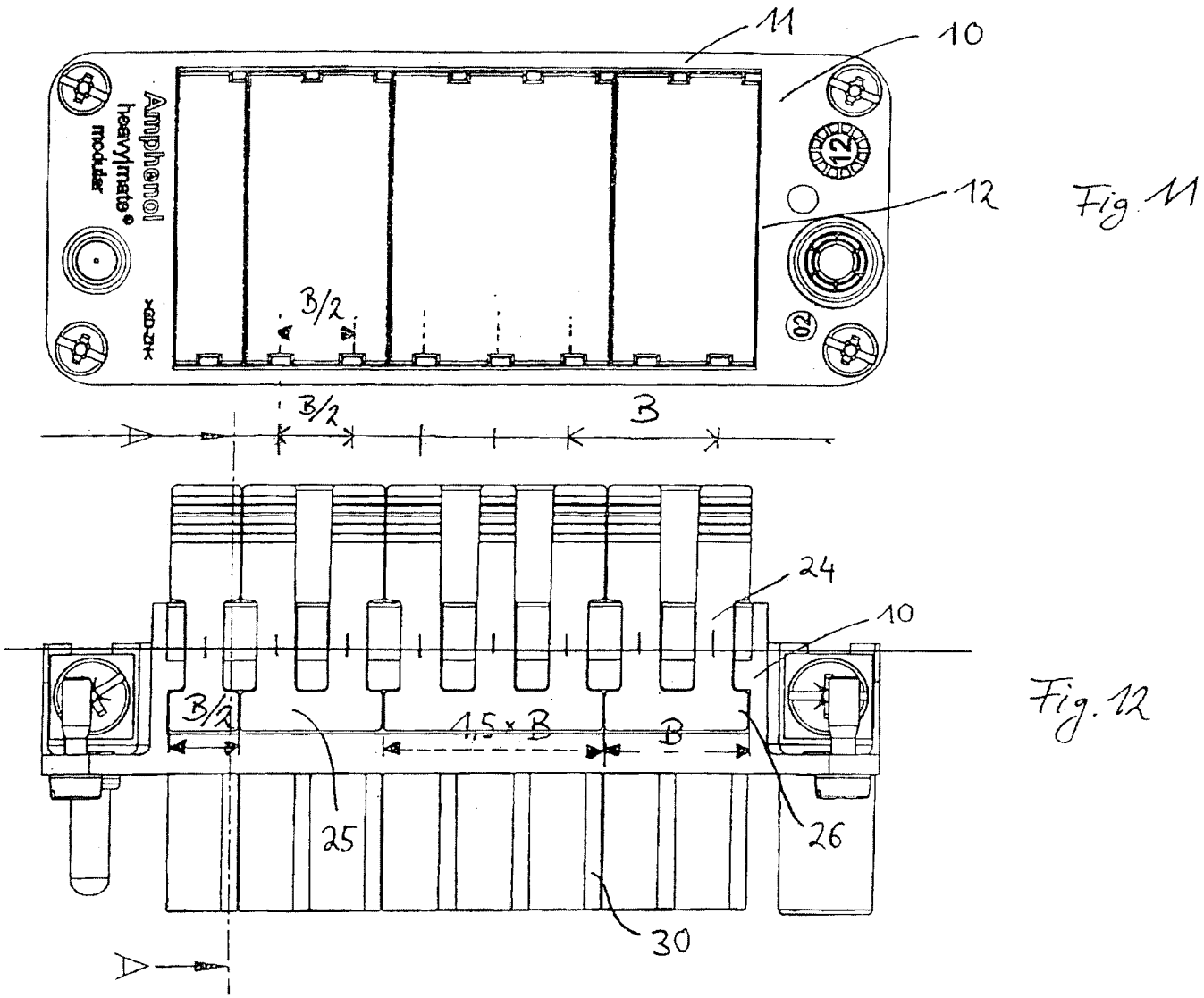
FIG. 11 illustrates a top view of a frame similar to FIG. 4.
FIG. 12 illustrates a side view of the plug-in connector in accordance with the invention in accordance with FIG. 9.

The contact carrier modules 20, 21 comprise locating grooves 31 on their side. These locating grooves 31 correspond to locating ribs 30 such as those that are illustrated in FIG. 4 and FIG. 11. As a result of a laterally offset arrangement of the locating ribs 30 on each side of the contact carrier modules 20 and accordingly, correspondingly offset positions of the locating ribs 30 in the frame 10, as is evident in FIG. 11, it is not possible to insert the contact carrier modules 20 into different positions in the frame 10.

Furthermore, latching elements 23 are located on the sides of the contact carrier modules 20 and one or more latching arms 24 are arranged on said latching elements. Insofar as multiple latching arms 24 are linked to the latching element 23, said latching arms are connected to one another by way of a transverse connecting piece 25 and latching lugs 26 are embodied in each case on the left-hand and right-hand side of said transverse connecting piece.

It is further evident, that as the width of the module increases in each case the number of latching arms is increased. For each width of 0.5×B, a latching arm 24 is linked to the latching element 23. Consequently, a module having the width 2×B by way of example has four latching arms, as is illustrated in FIG. 1 in the right-hand side view.

FIG. 2*a*, FIG. 2*b*, FIG. 3 and FIG. 4 illustrate a frame in accordance with the invention. The frame 10 comprises in each case opposite-lying longitudinal side walls 11 and transverse side walls 12. The locating ribs 30 are located on the inner faces of the longitudinal side walls 11. Latching elements 13 or rather as is illustrated in this exemplary embodiment latching ribs 13 are located on the outer faces of the longitudinal side walls 11. The latching ribs 13 comprise a ramp section 14 that extends in an inclined manner.

Figure 3:
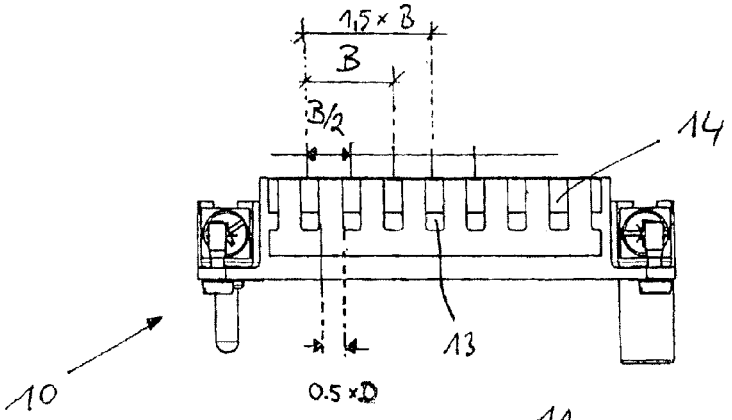
FIG. 3 illustrates a side view of the frame shown in FIG. 2*a* and FIG. 2*b;*

As is clearly evident in FIG. 3, the latching ribs 13 or rather latching elements 13 are in a fixed grid having the grid dimensions of 0.5×B. The grid dimensions can be measured from in each case two left-hand side outer edges, two right-hand side outer edges or as in FIG. 3 from center to center in each case of two adjacent latching elements 13. The clearance spacing between two lateral edges of respective adjacent latching elements 13 amounts to 0.5×D.

In a particularly preferred embodiment, D=B.

As is evident in FIG. 4, the identical grid dimension of latching ribs 13 is evident in each case on the outer face of each longitudinal side wall 11.

In FIG. 5 to FIG. 9, various configurations and therefore variants of configurations of a frame 10 in accordance with the invention in accordance with FIG. 2*a* to FIG. 4 are equipped with contact carrier modules 20, 21 in accordance with FIG. 1.

FIG. 1 illustrates by way of example a configuration of standard modules 20, 21, wherein 4×a basic contact carrier module 21 is latched to the frame 10.

Figure 6:
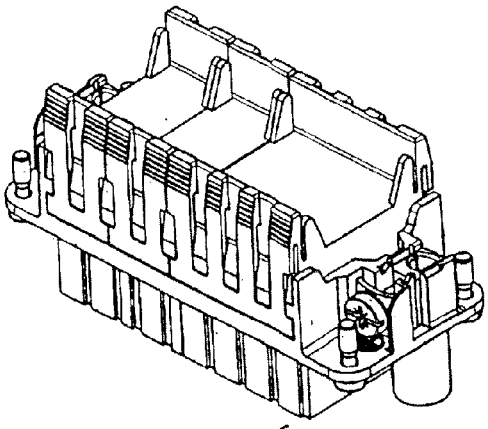
FIG. 6 illustrates a second variant of the configuration in accordance with FIG. 5.

FIG. 6 illustrates a configuration of 2×a standard contact carrier module 21 of the width B and a configuration having a contact carrier module 20 of the width 2×B.

Figure 7:
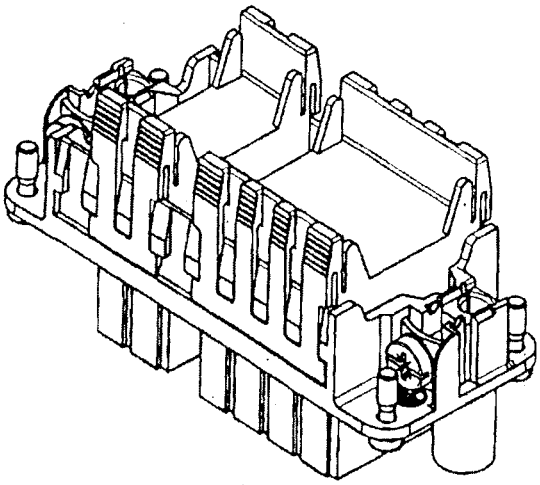
FIG. 7 illustrates a third alternative variant of the configuration of contact carrier modules similar to FIG. 5.
Figure 8:
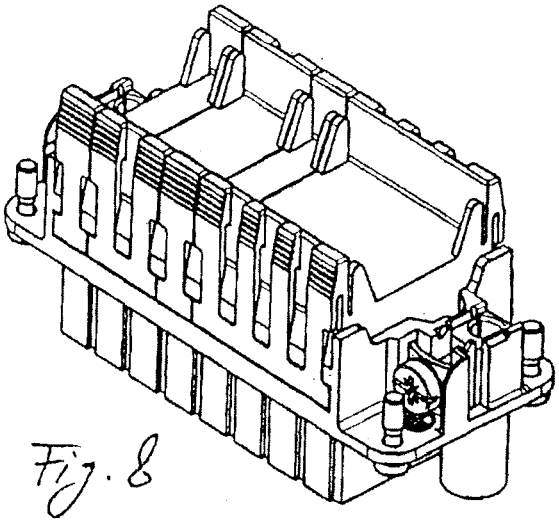
FIG. 8 illustrates a further variant of an embodiment of a configuration of contact carrier modules similar to FIG. 5 to FIG. 7.

FIG. 7 illustrates a configuration with a module 21 of the width B in an intermediate position and a contact carrier module 20 with the width 2×B, whereby an intermediate space of the width 0.5×B is formed between the two contact carrier modules 20, 21.

In this manner, air and creepage clearances can increase, in that an intermediate space is embodied between adjacent modules. If the configuration consists of contact carrier modules 20, 21 of a module of the width 2×B, one module of the width 1×B and two modules of the width 0.5×B.

Figure 9:
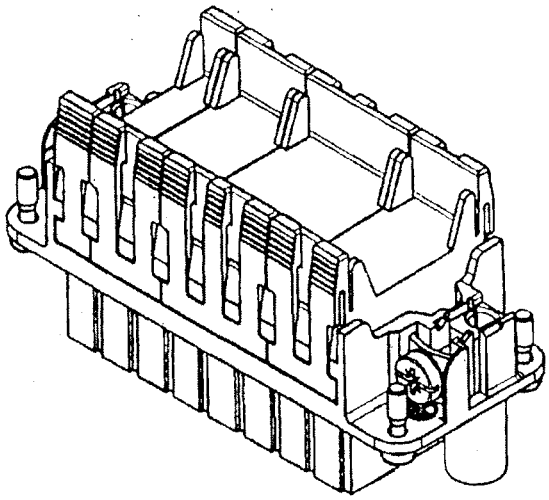
FIG. 9 illustrates a further alternative similar to FIG. 5 to FIG. 8.

FIG. 9 illustrates by way of example a configuration with a module 20 of the width 0.5×B, a module 20 of the width 1.5×B and two modules 21 of the width B, in other words two basic contact carrier modules 21.

FIG. 10 illustrates a section through a contact carrier module 20, 21. The depth of the contact carrier module 20 is indicated with the width T and the height of the contact carrier module 20 is indicated with the height H.

The latching element 23 is arranged laterally on the side walls and the latching arm 24 is attached to said latching element.

FIG. 11 illustrates a top view of a frame 10 in which the position of the locating ribs 30 is clearly illustrated. The upper row of locating ribs 30 in FIG. 11 that are embodied on the inner face of the longitudinal side wall 11 is displaced with respect to the lower row of locating ribs 30 that is embodied on the opposite-lying side wall 11. As a consequence, it is ensured that the contact carrier modules 20, 21 can only be plugged into the frame 10 in one alignment provided that accordingly corresponding latching grooves 31 are provided in an identical manner in the contact carrier modules 20, 21.

FIG. 12 illustrates a side view of FIG. 9. It is clearly evident how the solution in accordance with the invention is applied to the contact grid in the half width of a basic contact carrier module 21.

The latching arms 24 are arranged in the grid with a grid dimension of 0.5×B so that even the spacing between latching arms of adjacent latching arms in other words of directly adjacent latching arms of various contact carrier modules 20, 21 are latched with the same spacing on the frame 10. By virtue of the fact that latching lugs 26 are arranged on the lower end of the latching arms 24 and indeed in the extension of the transverse connecting piece 25 a particularly good holding arrangement is provided in the case of a fixed grid dimension.

The invention is not limited to the present exemplary embodiment, rather it can also be further defined by means of combinations of various described features. Thus, by way of example, it is also possible to provide frames 10 that are provided with a clearly larger longitudinal extension so that it is also possible to arrange contact carrier modules 20, 21 that have a dimension that is greater than 2×B and indeed have a whole- or half-integral multiple of the dimension 0.

LIST OF REFERENCE NUMERALS

Module Plug-in Connector
10 Frame
11 Longitudinal Side Wall
12 Transverse Side Wall
13 Latching Ribs
14 Ramped Section
20 Contact Carrier Module
21 Basic Module
23 Latching Element
24 Latching Arm
25 Transverse Connecting Piece
26 Latching Lug
30 Locating Ribs
31 Locating Grooves
B Width of the Module
T Depth of the Module
H Height of the Module

The invention claimed is:

1. A plug-in connector, comprising:

a frame formed from two opposite-lying longitudinal side walls and two opposite-lying transverse side walls, each longitudinal side wall extending in a longitudinal direction, and at least two contact carrier modules each having a width of 0.5×B, 1×B, 1.5×B, or 2×B, the at least two contact carrier modules are received in the frame and latch with the frame and each of the contact carrier modules includes at least one latching element that comprises multiple latching arms and cooperates with a corresponding mating latching element that is arranged on the frame in order to detachably fasten the contact carrier modules in the frame, wherein a fixed grid of latching elements is arranged on an exterior of the longitudinal side walls of the frame in a uniform grid spacing of the mating latching elements of each of the contact carrier modules, wherein the frame includes first locating ribs on an inner face of one of the longitudinal side walls, the first locating ribs being spaced from each other in the longitudinal direction, and second locating ribs on the other of the longitudinal side walls, the second locating ribs being spaced from each other in the longitudinal direction, and wherein the first and second locating ribs are offset from one another in the longitudinal direction, the first and second locating ribs have substantially the same width and receive corresponding locating grooves on the contact carrier modules, and wherein the multiple latching arms of each contact carrier module are connected to one another by way of a transverse connecting piece and consequently in each case a latching window recess is embodied between two adjacent latching arms.

2. The plug-in connector as claimed in claim 1, characterized in that each contact carrier module comprises in each case a latching element on two sides that lie opposite one another.

3. The plug-in connector as claimed in claim 1, characterized in that the respective adjacent latching arms of directly adjacent contact carrier modules that latch in the frame are embodied on the contact carrier module with a spacing of 0.5×B.

4. The plug-in connector as claimed in claim 1, characterized in that the contact carrier modules are provided with a locating groove in each case on a side that faces the longitudinal side edge of the frame.

5. The plug-in connector as claimed in claim 4, characterized in that the contact carrier modules are provided with a locating groove in each case on the respective second opposite-lying side that is aligned with the opposite-lying longitudinal side edge of the frame, and said locating grooves are arranged in each case diametrically offset with respect to one another so that the contact carrier module can only be plugged in and latched in a single alignment in the frame.

6. The plug-in connector as claimed in claim 1, characterized in that the frame comprises the locating ribs on the inner face of each of its longitudinal side walls in a grid with the grid dimensions of 0.5×B and wherein in each case opposite-lying locating ribs are arranged diametrically offset with respect to one another.

7. The plug-in connector as claimed in claim 1, characterized in that furthermore a basic contact carrier module of the width B is provided.

8. The plug-in connector as claimed in claim 1, characterized in that furthermore a contact carrier module of the width 0.5×B is provided.

9. The plug-in connector as claimed in claim 1, characterized in that furthermore a contact carrier module of the width 1.5×B is provided.

10. The plug-in connector as claimed in claim 1, characterized in that furthermore a contact carrier module of the width 2.0×B is provided.

11. A plug-in connector, comprising:

a frame that receives at least two contact carrier module having a width B, the frame having first and second opposite-lying longitudinal walls and first and second opposite-lying transverse side walls extending between the longitudinal walls, each of the first and second longitudinal walls extending in a longitudinal direction;

at least one latching element disposed on the exterior of the first and second longitudinal walls;

at least one first locating rib disposed on an inner face of the first longitudinal wall and at least one second locating rib disposed on an inner face of the second longitudinal wall facing the inner face of the first longitudinal wall, the at least one first and second locating ribs having substantially the same width, the at least one first locating rib of the first longitudinal wall and the at least one second locating rib of the second longitudinal wall being offset from each other in the longitudinal direction, and the at least one locating rib of the first longitudinal wall and the at least one locating rib of the second longitudinal wall engaging the at least one contact carrier module; and wherein at least one latching arm is formed on each carrier module, the latching arms are connected to one another by way of a transverse connecting piece and consequently in each case a latching window recess is embodied between two adjacent latching arms.

12. A plug-in connector according to claim 11, wherein a fixed grid of latching elements is arranged on the exterior of the longitudinal side walls of the frame in a uniform grid spacing of the latching elements of 0.5×B.

13. A plug-in connector according to claim 11, further comprising multiple locating ribs disposed on the inner face of the first longitudinal wall; and multiple locating ribs disposed on the inner face of the second longitudinal wall, and the multiple locating ribs disposed on the first longitudinal wall are offset from the multiple locating ribs disposed on the second longitudinal wall.

14. A plug-in connector according to claim 13, wherein the multiple locating ribs are disposed on the first longitudinal wall in a grid with grid dimensions of 0.5×B; and the multiple locating ribs are disposed on the second longitudinal wall in a grid with grid dimensions of 0.5×B.

* * * * *